United States Patent [19]

Sheratte

[11] 3,951,837

[45] Apr. 20, 1976

[54] FUNCTIONAL FLUID COMPOSITIONS

[75] Inventor: Martin B. Sheratte, Reseda, Calif.

[73] Assignee: McDonnell Douglas Corporation, Long Beach, Calif.

[22] Filed: Sept. 24, 1973

[21] Appl. No.: 400,122

[52] U.S. Cl. ..... 252/78; 252/49.8

[51] Int. Cl.[2] ..... C10M 3/02

[58] Field of Search ..... 252/73, 78, 49.8, 52 A

[56] References Cited

UNITED STATES PATENTS

| | | | |
|---|---|---|---|
| 3,203,955 | 8/1965 | Jackson et al. | 252/52 R |
| 3,256,211 | 6/1966 | Bailey, Jr. et al. | 252/52 R |
| 3,637,507 | 1/1972 | Gentit | 252/78 |

*Primary Examiner*—Benjamin R. Padgett
*Assistant Examiner*—Deborah L. Kyle
*Attorney, Agent, or Firm*—Max Geldin

[57] ABSTRACT

Novel functional fluid compositions consisting essentially of (1) a phosphate ester, e.g. dibutyl phenyl phosphate, or an amide of an acid of phosphorus, (2) a polyglycol or polyglycol ether viscosity index improver, e.g. polypropylene glycol methyl ether of molecular weight about 3,000, and (3) a small amount of a polyepoxide, e.g. an epoxy novolac of high epoxide functionality, the combination of polyglycol or polyglycol ether viscosity index improver and polyepoxide preventing acid build-up in the fluid, and preventing excessive deposits particularly when such fluid is employed as an aircraft hydraulic fluid.

25 Claims, No Drawings

FUNCTIONAL FLUID COMPOSITIONS

BACKGROUND OF THE INVENTION

Many different types of materials are employed as functional fluids, and functional fluids are utilized in a wide variety of applications. Thus, such fluids have been utilized as electronic coolants, diffusion pump fluids, lubricants, damping fluid, power transmission and hydraulic fluids, heat transfer fluids and heat pump fluids. A particularly important application of such functional fluids has been their utilization as hydraulic fluids and lubricants in aircraft, requiring successful operation of such fluids over a wide temperature range, and fire resistant fluids.

Functional and hydraulic fluids employed in many industrial applications and particularly hydraulic fluids for aircraft must meet a number of important requirements. Thus, such hydraulic fluids particularly for aircraft use, should be operable over a wide temperature range, should have good stability at relatively high temperatures and preferably have lubricating characteristics. In addition to having the usual combination of properties making it a good lubricant or hydraulic fluid, such fluid should also have relatively low viscosity at extremely low temperatures and an adequately high viscosity at relatively high temperatures, and must have adequate stability at the high operating temperatures of use. Further, it is of importance that such fluids be compatible with and not adversely affect materials including metals and non-metals such as seals of the system in which the fluid is employed. It is also important in aircraft hydraulic fluids and lubricants that such fluids have as high a fire resistance as possible to prevent ignition if such fluids are accidentally or as result of damage to the hydraulic system, sprayed onto or into contact with surfaces of materials of high temperature. Another important property for application of a hydraulic fluid in aircraft is the provision of a low density fluid to increase pay load.

Hydraulic fluids in commercial jet aircraft are exposed to temperatures ranging from below −40°F to over 200°F. Within these temperature extremes, it is necessary for the fluid to maintain a reasonably low viscosity when cold, and yet not become too thin when hot.

In presently available commercial functional or hydraulic fluids, phosphate esters are among the most commonly employed base stocks, of which tributyl phosphate and dibutyl phenyl phosphate are widely used components. Both of the latter phosphates are too thin at high temperatures, and their use alone would result in rapid wear of moving parts. Other phosphate esters, such as tricresyl phosphate, for example, which provide the requisite high temperature viscosity become too thick to be useful at low temperatures. Even mixtures of various phosphate esters such as those noted above do not provide the required viscosity characteristics at both low and high temperatures. Accordingly, it has been the practice to achieve the required wide viscosity range required for aircraft hydraulic fluids by adding to a thin base stock, such as phosphate ester or mixtures thereof, a small proportion, e.g., up to 10%, of a polymeric material such as polyalkyl acrylates or methacrylates, whose solubility characteristics in the base stock are chosen so that the polymeric material thickens the fluid more at high temperatures than at low temperatures, and thus functions as a viscosity index (VI) improver.

However, during use, fluids of the above type containing polymers such as the polyalkyl acrylates or methacrylates, tend to decompose due to the shearing forces of the mechanical components encountered in an aircraft hydraulic system, on the fluid, and producing acids. This results in a high degree of acid build-up during use, which is detrimental in causing corrosion of metal surfaces with which the fluid is in contact and also causes further decomposition of the fluid.

In U.S. Pat. No. 3,637,507, improved acid stability of such functional or hydraulic fluids is achieved by the addition of monoepoxides and particularly certain diepoxides to hydraulic fluids containing a phosphate ester and particularly polyalkyl methacrylate viscosity index improver. However, in currently manufactured fluids of this type, the functionality of the epoxide is severly limited by the reaction which epoxides can have with acrylate and methacrylate viscosity index improver. Thus, although diepoxides such as the 3,4-epoxycyclohexylmethyl 3,4-epoxycyclohexane carboxylate disclosed in the above patent are preferred over the monoepoxide in the above fluids, the concentration of the latter diepoxide must be kept low since the reaction of polyfunctional epoxides with acrylate and methacrylate type viscosity index improvers leads to the formation of harmful insoluble deposits in aircraft hydraulic systems. Thus, it is particularly noteworthy that in all of the examples of the above patent, and employing polyalkyl methacrylate viscosity index improver, the concentration of the epoxide component, including the above-noted preferred diepoxide of the patent, is employed in a concentration ranging only from about 0.5 to about 1%. The necessity for using such low concentrations of such diepoxides in order to avoid formation of undesirable deposits in the fluid, due to reaction with acrylate and methacrylate viscosity index improvers, limits the effectiveness of such epoxides in preventing acid build-up.

The present invention relates to functional fluid compositions having good fire resistance and desirable viscosity characteristics at both high and low temperatures, and is particularly directed to functional fluid compositions having the above-noted properties and consisting essentially of a phosphorus compound, especially a phosphate ester, a particular viscosity index improver other than a polyacrylate or polymethacrylate, and an epoxide compound of a type which permits use of a high concentration of such epoxide in conjunction with said viscosity index improver, to effectively prevent formation of harmful insoluble deposits in the fluid while effectively functioning as an acid absorber to prevent acid build-up.

DESCRIPTION OF THE INVENTION

It has now been found that polyepoxides of high epoxide functionality can be effectively employed as acid absorbers in functional or hydraulic fluids, employing particularly a phosphorus ester, or mixtures thereof, when utilizing as viscosity index improver, a glycol material such as a polyglycol or a polyglycol ether, instead of polyacrylates, to prevent precipitation of harmful deposits in the fluid.

The advantage of employing polyepoxides lies in their generally greater efficiency in acid absorption over the monoepoxides. This is due to the fact that monoepoxides of relatively high molecular weight must be used in functional and hydraulic fluids to avoid skin sensitization and volatility problems. On the other hand, polyepoxides of substantially the same molecular weight contain more epoxy groups, and hence can absorb more acid per unit weight. The ability to employ polyepoxides to obtain this advantage is achieved according to the invention by the use of a polyglycol or polyglycol ether as viscosity index improver, since the latter viscosity index improvers do not react with the polyepoxides, whereas such polyepoxides do react with acrylate and methacrylate viscosity index improvers to form harmful deposits as noted above.

The polyepoxides employed according to the invention are epoxy compounds containing two or more epoxy groupes, and hence having an epoxide functionality of at least 2. Such compounds have the general formula

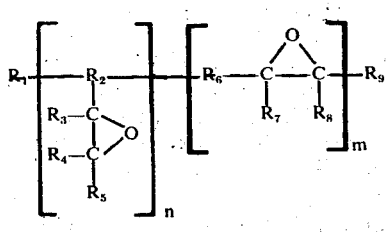

pylene, arylene, such as phenylene, amino alkylene, for example amino methylene or amino ethylene, amino arylene, such as amino phenylene, ether, including aryl ether, e.g., phenyl ether, alkyl aryl ether; e.g., methyl phenyl ether, and the like, polyether, carboxylic acid ester, polyglycol ether, or dicarboxylic acid radicals; e.g., adipic or sebacic acid radicals.

Examples of alkyl groups which can be employed include straight or branched chain alkyl such as methyl, ethyl, propyl, isopropyl, butyl, isobutyl, amyl, isoamyl, hexyl, ethyl butyl, heptyl, octyl and isooctyl. Such alkyl groups can also be substituted with halogen atoms, e.g., chlorine or fluorine, to form halogenated alkyl radicals.

Examples of aryl radicals which can be employed include phenyl, and substituted phenyl, e.g. cresyl, xylyl, and wherein said aryl groups can be halogenated, e.g. chlorinated or fluorinated phenyl.

The values $n$ and $m$ in the above general formula individually can range from 0 to 100, but wherein $n$ plus $m$ equals at least 2.

Thus, there can be employed according to the present invention epoxy novolacs, an example of which are the compounds having the formula

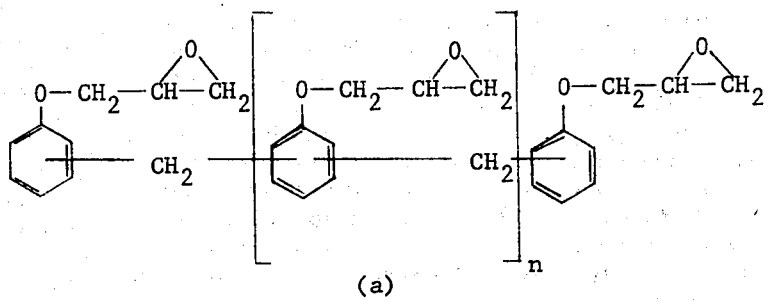

(a)

wherein $R_1$, $R_3$, $R_4$, $R_5$, $R_7$, $R_8$ and $R_9$ can be hydrogen, alkyl having from 1 to about 8 carbon atoms, and aryl of about 6 to about 8 carbon atoms, and wherein $R_3$ and $R_4$, or $R_7$ and $R_8$, together, respectively, can be the carbon atoms necessary to complete a cycloalkyl group of from about 5 to about 6 carbon atoms such as cylopentyl or cyclohexyl, and $R_2$ and $R_6$ are divalent or trivalent organic radicals containing from 1 to about 20 carbon atoms, usually 1 to about 8 carbon atoms, including alkylene, such as methylene, ethylene or propylene, arylene, such as phenylene, amino alkylene, for example amino methylene or amino ethylene, amino arylene, such as amino phenylene, ether, including aryl ether, e.g., phenyl ether, alkyl aryl ether; e.g., methyl phenyl ether, and the like, polyether, carboxylic acid ester, polyglycol ether, or dicarboxylic acid radicals; e.g., adipic or sebacic acid radicals.

wherein $n$ can range from 0 to about 10. Examples of epoxy novolacs within the above general formula are the epoxy compounds marketed as Epon 152 and Epon 154, wherein $n$ is between 0 and 1, and $n$ is between 1 and 2, respectively, and the products marketed as DEN 431 and 438, wherein $n$ is usually greater than 5, e.g. about 5–10.

Further examples of a polyepoxide which can be employed are the polyglycidyl ethers of phenols and polyphenols such as those set forth below.

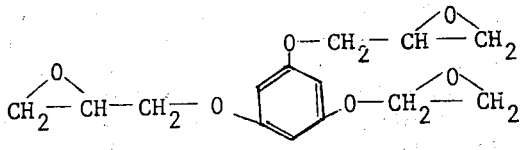

Triglycidyl ether of Phloroglucinol (b)

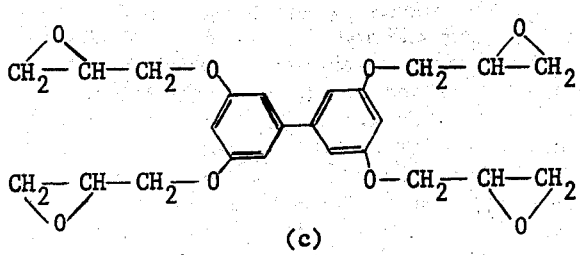

(c)

Tetraglycidyl ether of tetrahydroxy biphenyl

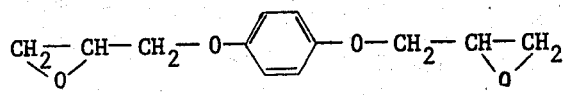

(d)

Diglycidyl ether of hydroquinone

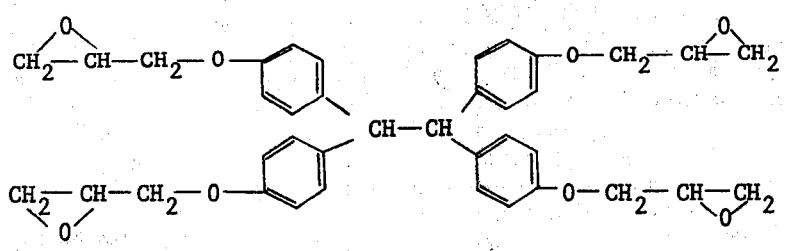

(e)

Tetraglycidyl ether of tetrakis - (4-oxy phenyl) ethane

A material having the above formula is marketed as Epon 1031.

Other polyepoxy compounds which can be employed are the poly glycidyl amines, an example of which is noted below:

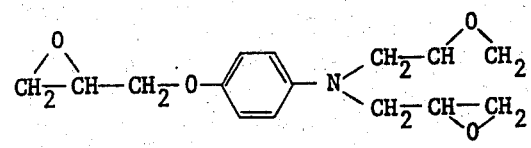

(f)

Triglycidyl p-aminophenol

Also, polepoxide esters can be employed, an example of which is the 3,4-epoxycyclohexyl ester of 3,4-epoxycyclohexyl acetic acid having the following formula:

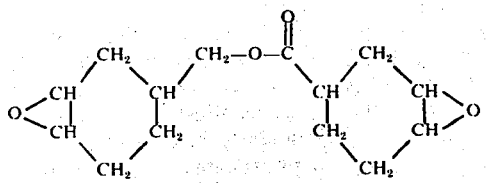

(g)

The material marketed as Unox 221 is understood to be a compound of the above general formula (g).

Examples of other polyepoxy compounds which can be employed are the following:

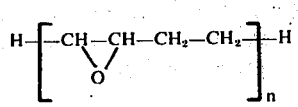

(h)

epoxidized polybutadiene

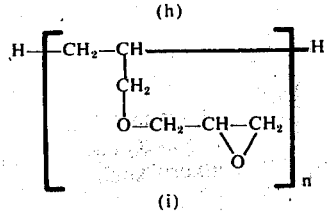

(i)

polyallyl glycidyl ether wherein $n$ can range from 2 to about 100.

Preferred polyepoxides include epoxy novolacs, polyglycidyl ethers of phenols and polyphenols, polyepoxide esters, epoxidized polybutadiene and polyalyl glycidyl ether, and particularly the compounds (a), (e), (g), and also compounds (h) and (i).

All of the above polyepoxides are known compounds and their method of preparation is likewise known.

The viscosity index improvers employed according to the present invention are high molecular weight polyalkylene glycol materials including polyalkylene glycols, e.g. polypropylene glycol, although the preferred viscosity index improvers are mono- or diethers of polyalkylene glycols, or mixtures thereof. The ether end groups which are preferable and are present on the polyalkylene glycol viscosity index improvers hereof are preferably oxyalkyl groups, the alkyl radicals of which can range from 1 to about 8 carbon atoms in length, and preferably polyalkylene glycol mono, or diethers are employed having end alkyl groups of from 1 to 4 carbon atoms. Thus, preferred end alkyl groups are for example, methyl, ethyl, n-propyl, isopropyl, n-butyl, isobutyl, and the like, particularly methyl and butyl radicals.

The alkylene groups of the polyalkylene glycol viscosity index improver material can be an ethylene, propylene, or butylene group, or mixtures thereof, e.g. copolymers containing ethylene and propylene groups. The propylene polymers and ethylene-propylene copolymers are preferred, particularly the polypropylene glycol and copolymer of ethylene oxide and propylene oxide, mono- and diethers.

The above polyalkylene glycol and ethers of polyalkylene glycol are well known and are prepared in known manner. Thus generally mono- or diethers of polyalkylene glycols of the type noted above can be produced by polymerization in known manner of ethylene oxide, propylene oxide or butylene-1-oxide or butylene-2-oxide, or mixtures of any one or all of these oxides.

The molecular weight of the polyalkylene glycol or polyalkylene glycol ether viscosity index improvers can range from about 2,000 to about 20,000, preferably from about 2,000 to about 10,000.

Preferred polyalkylene glycol ethers include the copolymer of ethylene oxide and propylene oxide, monobutyl ether, having a molecular weight ranging from about 4,000 to about 5,000, and polypropylene glycol monomethyl ether, having a molecular weight ranging from about 2,000 to about 3,000.

The base stock component of the functional fluid containing the above defined glycol-type viscosity index improver in combination with the above-defined polyepoxides, is a phosphorus compound selected from the group consisting of phosphorus esters and amides of an acid of phosphorus, or mixtures thereof.

Phosphorus esters which can be employed according to the invention have the general formula:

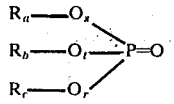

where $s$, $t$ and $r$ can be 0 or 1, and not more than two of $s$, $t$, and $r$ can be 0, where $R_a$, $R_b$ and $R_c$ each can be aryl such as phenyl and naphthyl, alkaryl such as cresyl, xylyl, ethyl phenyl, propyl phenyl, isopropyl phenyl, and the like, said aryl and alkaryl radicals preferably containing from 6 to about 8 carbon atoms, alkyl, both straight chain and branched chain of from about 3 to about 10 carbon atoms such as n-propyl, n-butyl, n-amyl, n-hexyl, ispropyl, isobutyl, and the like, and alkoxyalkyl having from about 3 to about 8 carbon atoms such as methoxy methyl, methoxy ethyl, ethoxy ethyl, methoxy propyl, and the like.

The corresponding phosphonates can also be employed, where one of $s$, $t$ and $r$ is 0, and the corresponding phosphinates where two of $s$, $t$ and $r$ are 0.

Preferred phosphorus esters are the dialkyl aryl, triaryl, trialkyl and alkyl diaryl phosphates.

Examples of such phosphate esters are the dialkyl aryl phosphates in which the alkyl groups are either straight chain or branched chain and contain from about 3 to about 10 carbon atoms, such as n-propyl, n-butyl, n-amyl, n-hexyl, isopropyl, isobutyl, isoamyl, and the aryl radicals have from 6 to 8 carbon atoms and can be phenyl, cresyl or xylyl, particularly dialkyl phenyl phosphates including dibutyl phenyl phosphate, butyl amyl phenyl phosphate, butyl hexyl phenyl phosphate, butyl heptyl phenyl phosphate, butyl octyl phenyl phosphate, diamyl phenyl phosphate, amyl hexyl phenyl phosphate, amyl heptyl phenyl phosphate, and dihexyl phenyl phosphate.

Examples of triaryl phosphates which can be employed in the invention compositions are those in which the aryl radicals of such phosphates have from 6 to 8 carbon atoms, that is, may be phenyl, cresyl or xylyl, and in which the total number of carbon atoms in all three of the aryl radicals is from 19 to 24, that is, in which the three radicals include at least one cresyl or xylyl radical. Examples of such phosphates include tricresyl, trixylyl, phenyl dicresyl, and cresyl diphenyl phosphates.

Examples of trialkyl phosphates employed according to the invention include phosphates having alkyl groups which are either straight chain or branched chain with from about 3 to about 10 carbon atoms, such as n-propyl, n-butyl, n-amyl and n-hexyl, particularly tri-n-butyl phosphate, tri (ethyl hexyl) phosphate and triisononyl phosphate, the straight chain alkyl groups preferably containing from 4 to 6 carbon atoms.

Examples of alkyl diaryl phosphates which can be employed to produce the invention compositions include those in which the aryl radicals of such phosphates may have from 6 to 8 carbon atoms and may be phenyl, cresyl or xylyl, and the alkyl radical may have from about 3 to about 10 carbon atoms, examples of which are given above. Examples of the alkyl diaryl phosphates include butyl diphenyl, amyl diphenyl, hexyl diphenyl, heptyl diphenyl, octyl diphenyl, 6-methyl heptyl diphenyl, 2-ethylhexyl diphenyl, butyl phenyl cresyl, amyl phenyl xylyl, and butyl dicresyl phosphates.

Any phosphate ester can be employed which preferably is normally liquid between about −65°F and 210°F. The above-noted trialkyl phosphates such as tributyl phosphate or tri-n-hexyl phosphate are particularly effective in achieving low viscosity at low temperature. However, for improved higher viscosity at high temperature of the order of 210°F, it is desirable to employ triaryl phosphates as illustrated above, e.g. tricresyl phosphate, particularly in combination with the above-noted trialkyl phosphates.

Preferred phosphate esters are the above-noted dialkyl aryl phosphates such as dibutyl phenyl phosphate, trialkyl phosphates such as tributyl phosphate, and alkyl diaryl phosphates such as octyl diphenyl phosphate, which can be employed separately or in combination.

Functional fluid base stocks according to the invention also can include phosphonate and phosphinate esters having alkyl and aryl groups corresponding to those defined above with respect to the phosphate esters.

Examples of phosphinate esters to which the invention principles are applicable include phenyl-di-n-propyl phosphinate, phenyl-di-n-butyl phosphinate, phenyl-di-n-pentyl phosphinate, p-methoxyphenyl-di-n-butyl phosphinate, tert-butylphenyl-di-n-butyl phosphinate. Examples of phosphonate esters to which the invention is applicable include aliphatic phosphonates such as an alkyl alkenyl phosphonate, e.g., dioctyl isooctene phosphonate, an alkyl alkane phosphonate such as di-n-butyl n-octane phosphonate, di-isooctyl pentane phosphonate, and dimethyl decane phosphonate, a mixed aryl phosphonate, for example, dioctyl phenyl phosphonate, di(n-amyl) phenyl phosphonate, di(n-butyl) phenyl phosphonate, phenyl butyl hexane phosphonate and butyl bis-benzene phosphonate.

Another class of phosphorus compunds which can be employed according to the invention are the amides of acids of phosphorus, e.g., amido phosphates, including the mono-, di- and triamides of an acid of phosphorus, an example of which is phenyl N-methyl-N-n-butyl-N-′-methyl-N′ -n-butyl phosphorodiamidate. Additional examples are m-cresyl-p-cresyl, N,N-dimethylphosphoro-amidate, di-m-cresyl-N,N-dimethyl-phosphoroamidate, di-p-cresyl-N,N-dimethyl-phosphoroamidate, phenyl-N,N-dimethyl-N-′,N′-dimethylphosphorodiamidate, N-methyl-N-butyl-N′-N″-tetramethylphosphorotriamidate, N,N′ -di-n-propyl-N″-dimethylphosphorotriamidate.

Generally the base stock component of the functional or hydraulic fluid of the present invention, e.g., the phosphorus esters, is employed in major proportion and the polyalkylene glycol material employed as viscosity index improver and the polyepoxide employed as acid acceptor are employed in effective minor or small proportions in the fluid. Thus, the phosphorus esters and amides of an acid of phosphorus, or mixtures thereof, are generally employed in an amount ranging from about 60 to about 99.8%, preferably from about 75 to about 98%, the polyalkylene glycol or polyalkylene glycol ether viscosity index improver in an amount generally ranging from about 0.1 to about 30%, preferably from about 1 to about 15%, and the polyepoxide generally is employed in an amount ranging from about 0.1 to about 10%, preferably about 1 to about 10%, by weight, and most desireably employing an amount more than 1% of the polyepoxide, particularly about 2 to about 10%.

It will also be understood that other commonly employed additives such as corrosion inhibitors, oxidation inhibitors, stabilizers, metal deactivators, and the like, such as dialkyl sulfides, benzothiazole, phenyl alpha naphthylamine and phenolic oxidization inhibitors, well known as functional fluid additives in the art, can also be incorporated in the functional fluid composition of the invention, in relatively small amounts, if desired.

The following are examples illustrating functional fluid compositions according to the invention, such examples being only illustrative and are not intended as limitative of the invention.

EXAMPLE 1

The following composition containing a phosphate ester, a polyalkylene glycol ether and a polyepoxide was prepared.

COMPOSITION A

| Components | Per cent by weight |
|---|---|
| Dibutyl phenyl phosphate | 91.0 |
| Ucon 50 HB 5100 (a polyglycol ether) | 7.0 |
| Epon 152 (a polyepoxide) | 1.3 |
| 1,2-bis (phenylthio) ethane | 0.3 |
| Water | 0.4 |
| | 100.0 |

Ucon 50 HB 5100 is understood to be the copolymer of ethylene oxide and propylene oxide, monobutyl ether, molecular weight 4,000–5,000.

The above composition or fluid had the following properties:

Table 1

| | | |
|---|---|---|
| AIT (autoignition temperature) | 920°F | |
| Flash Point | 360°F | |
| Fire Point | 420°F | |
| Density | 1.051 | |
| Viscosity | | |
| | −65°F | 4150 cs (centistokes) |
| | 210°F. | 3.00 cs |

Closed oxidation-corrosion tests at 250°F for 168 hours were carried out in two tests on each of the metals listed in Table 2 below, the respective metals being immersed in a separate liquid composition A in each of the two tests. The results of these tests are set forth in Table 2 below, in terms of weight change in mg/cm² for each of the metals in each of the two tests.

Table 2

| | Test 1 | Test 2 |
|---|---|---|
| Iron | 0 | 0 |
| Bronze | 0 | — |
| Copper | — | −0.05 |
| Cadmium plate | −0.04 | −0.29 |
| Aluminum | 0 | 0 |
| Titanium | 0 | — |
| Magnesium | — | +0.20 |

The acid number for the fluid in both tests increased to 11.6, but the fluid remained clear throughout, with no trace of precipitate.

On the other hand, when the same closed-oxidation corrosion tests as noted above were carried out with a composition A¹ which was the same as composition A but containing 7.0% of poly n-butyl methacrylate, m.w. approximately 7,900, marketed as Polyacryloid HF-412, in place of the polyglycol ether of composition A, a large amount of precipitate was observed in the fluid following each of Tests 1 and 2. Further, it was noted that the acid number of the fluid composition A¹ at the end of these tests was about 18, substantially above the acid number of 11.6 when employing the polyglycol ether viscosity index improver according to the present invention.

EXAMPLE 2

The following functional or hydraulic fluid was prepared according to the invention.

COMPOSITION B

| Components | Per cent by weight |
|---|---|
| Dibutyl phenyl phosphate | 86.1 |
| Octyl diphenyl phosphate | 2.0 |
| Ucon 50 HB 5100 (a polyglycol ether) | 8.1 |
| Unox 221 (a diepoxide) | 3.1 |
| 1,2-bis (phenylthio) ethane | 0.3 |
| Water | 0.4 |
| | 100.0 |

Composition B above had the following properties:

Table 3

| | | |
|---|---|---|
| AIT | 930°F | |
| Flash Point | 380°F | |
| Fire Point | 420°F | |
| Density | 1.058 | |
| Viscosity | −65°F | 4020 cs |
| | 210°F | 3.05 cs |

Closed oxidation-corrosion tests at 250°F for 168 hours were carried out in two tests on each of the metals listed in Table 4 below, the respective metals being immersed in a separate liquid composition B in each of the two tests. The results of these tests are set forth in Table 4 below, in terms of weight change in mg/cm² for each of the metals in each of the two tests. The initial acid number and final acid number of the respective two fluids in both tests are also shown in Table 4 below.

Table 4

| | Test 1 | Test 2 |
|---|---|---|
| Iron | 0 | 0 |
| Bronze | 0 | — |
| Copper | — | −0.03 |
| Cadmium Plate | −0.04 | −0.02 |
| Aluminum | 0 | 0 |
| Titanium | 0 | — |
| Magnesium | — | −0.01 |
| Final Acid Number | 0.04 | 0.04 |
| Initial Acid Number | 0.04 | 0.04 |

It was noted that both of the fluids in the two tests were clear with no deposits therein throughout the tests, the fluids exhibiting a pale yellow tinge at the end of the tests. It is particularly noteworthy that the acid number of the fluids in both tests remained throughout at the initial low acid number of both fluids.

EXAMPLE 3

The following fluids are also illustrative of the functional or hydraulic fluids of the invention.

Table 5

| COMPONENTS | | COMPOSITIONS (% by weight) C | D | E | F | G | H | J |
|---|---|---|---|---|---|---|---|---|
| Dibutyl phenyl phosphate | | 85 | 88 | 45 | 64 | 75 | — | — |
| Octyl diphenyl Phosphate | | — | 2 | 18 | — | — | — | — |
| Tributyl phosphate | | — | 2 | 20 | 15 | — | 40 | — |
| Tricresyl Phosphate | | — | — | — | — | — | 40 | — |
| phenyl N-methyl-N-n-butyl-N'-methyl-N'-n-butyl phosphorodiamidate | | — | — | — | — | — | — | 90 |
| Ucon 50 HB 5100 | polyglycol ether | — | 6 | — | — | — | — | 7 |
| Jeffox OL 2700 | polyglycol ether | 11 | — | — | 15 | — | 6 | — |
| Ucon LB 1715 | polyglycol ether | — | — | 12 | — | 20 | 10 | — |
| Epon 152 | polyepoxide | — | 1.2 | — | — | 5 | — | 3 |
| Epon 1031 | polyepoxide | 2 | — | — | 6 | — | — | — |
| Unox 221 | polyepoxide | — | — | 4 | — | — | 4 | — |
| Additives | | 2 | 0.8 | 1 | — | — | — | — |

Jeffox OL 2700 is understood to be a polypropylene glycol monomethyl ether, molecular weight about 3,000.

Ucon LB 1715 is understood to be a polypropylene glycol monomethyl ether, molecular weight about 2,000.

The "additives" of Table 5 above include minor amounts of 1,2-bis (phenylthio) ethane, a perfluorinated sulfonic acid (corrosion inhibitor) and water.

It is noted that the polyepoxide component in Examples 1 to 3 above was employed in relatively high concentration ranging from 1.3 to 6% when employed in combination with a polyglycol ether as viscosity index improver, and resulting in maintaining the fluids containing phosphate ester base stock clear throughout the oxidation and corrosion tests, with no formation of precipitates or deposits in the fluids. On the other hand, in above U.S. Pat. No. 3,637,507, it is particularly noteworthy that when employing a polyepoxide such as a diepoxide, in a phosphate ester fluid containing polyacrylate or poly-methacrylate viscosity index improver, according to the examples of the patent, the concentration of the epoxide was relatively low, ranging from about 0.5 to about 1%, and having reduced effectiveness in acid absorption and prevention of harmful deposits. It has been found that the above-noted 3,4-epoxy cyclohexyl ester of 3,4-epoxy cyclohexyl acetic acid, in the presence of methacrylate viscosity index improver commences to form deposits at higher concentrations of such epoxide component. On the other hand, no deposits are formed when such diepoxide is employed in combination with the polyglycol or polyglycol ether viscosity index improvers employed according to the present invention, and rendering it possible to employ substantially higher concentrations of the diepoxide for effective control and prevention of such deposits when employing such polyglycol-type viscosity index improvers according to the invention. Such improved properties of functional or hydraulic fluids containing a phosphorus compound such as a phosphate ester, as base stock together or in combination with specifically a polyglycol or polyglycol ether viscosity index improver, and polyepoxide, is not disclosed or suggested in this patent.

Further, in addition to their valuable application as hydraulic fluids for aircraft hydraulic systems, the fluids according to the present invention have important application as a hydraulic or functional fluid in industrial and marine fields, particularly in industrial turbine systems.

From the foregoing, it is seen that in accordance with the invention, functional fluids designed particularly for use as hydraulic fluids in jet aircraft, are provided in the form of a mixture of a phosphorus compound, preferably a phosphate ester, and a polyalkylene glycol material, preferably a polypropylene glycol ether, of high molecular weight, as viscosity index improver, and a small amount of a polyepoxide of high epoxide functionality, resulting in functional or hydraulic fluids of controlled low acidity and absence of deposits harmful to hydraulic fluid system components, and at the same time having good thermal and hydrolytic stability, and which have comparable fire resistance and corrosion and pump wear resistance of conventionally employed phosphate ester base stocks.

While I have described particular embodiments of my invention for the purpose of illustration within the spirit of the invention, it will be understood that the invention is not to be taken as limited except by the scope of the appended claims.

I claim:

1. A functional fluid composition consisting essentially of (1) a major portion of a phosphorus compound selected from the group consisting of phosphorus esters and amides of an acid of phosphorus, and mixtures thereof, (2) a minor effective portion of a polyalkylene glycol viscosity index improver selected from the class consisting of polyalkylene glycols and polyalkylene glycol mono- and diethers containing at least one oxyalkyl end group wherein the alkyl radicals contain from 1 to about 8 carbon atoms, said alkylene groups being selected from the class consisting of ethylene, propylene and butylene, and mixtures thereof, said polyalkylene glycol viscosity index improver having a molecular weight ranging from about 2,000 to about 20,000 and (3) a small effective amount of a polyepoxide having the general formula:

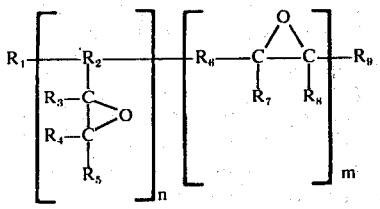

wherein $R_1$, $R_3$, $R_4$, $R_5$, $R_7$, $R_8$ and $R_9$ can be a member selected from the group consisting of hydrogen, alkyl having from 1 to about 8 carbon atoms, aryl of from about 6 to about 8 carbon atoms, and wherein $R_3$ and $R_4$, $R_7$ and $R_8$, together, respectively, can be the carbon atoms necessary to complete a cycloalkyl group of from about 5 to about 6 carbon atoms, $R_2$ and $R_6$ are divalent or trivalent organic radicals containing from 1 to about 20 carbon atoms, selected from the group consisting of alkylene, arylene, amino alkylene, amino arylene, ether, poly-ether, polyglycol ether, carboxylic acid ester and dicarboxylic acid radicals, and wherein *n* and *m* can range from 0 to 100, but wherein *n* plus *m* equals at least 2, and wherein said polyepoxide is present in an amount ranging from about 2 to about 10%, by weight.

2. A functional fluid composition as defined in claim 1, said phosphorus compound being present in an amount ranging from about 60 to about 99.8%, said polyalkylene glycol viscosity index improver being present in an amount ranging from about 0.1 to about 30%, up.

3. A functional fluid composition as defined in claim 2, said polyalkylene glycol viscosity index improver being a polyalkylene glycol ether containing at least 1 terminal oxyalkyl group of from 1 to 4 carbon atoms.

4. A functional fluid composition as defined in claim 3, said polyalkylene glycol ether being a member selected from the group consisting of polypropylene glycol and copolymer of ethylene oxide and propylene oxide, mono- and diethers.

5. A functional fluid composition as defined in claim 1, wherein said polyepoxide is selected from the group consisting of epoxy novalacs, polyglycidyl ethers of phenols and polyphenols, polyglycidyl amines, polyepoxide esters, epoxidized polybutadiene and polyalkyl glycidyl ethers.

6. A functional fluid composition as defined in claim 1, wherein said phosphorus compound is a phosphorus ester having the general formula:

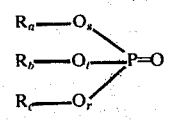

where *s*, *t* and *r* are each an integer of 0 to 1, and not more than two of *s*, *t* and *r* are 0, $R_a$, $R_b$ and $R_c$ are each a member selected from the group consisting of aryl, alkaryl, alkyl of from about 3 to about 10 carbon atoms, and alkoxy-alkyl having from about 3 to about 8 carbon atoms.

7. A functional fluid composition as defined in claim 1, wherein said phosphorus compound is a phosphate ester selected from the group consisting of dialkyl aryl, triaryl, trialkyl and alkyl diaryl phosphates, said alkyl groups containing from about 3 to about 10 carbon atoms and said aryl groups containing from 6 to 8 carbon atoms, the total number of carbon atoms in all three aryl groups in said triaryl phosphates being from 19 to 24.

8. A functional fluid composition as defined in claim 7, said polyalkylene glycol viscosity index improver being a polyalkylene glycol ether containing at least one terminal oxyalkyl group of from 1 to 4 carbon atoms.

9. A functional fluid composition as defined in claim 1, wherein said phophorus compound is a phosphate ester selected from the group consisting of dialkyl aryl, triaryl, trialkyl and alkyl diaryl phosphates, said alkyl groups containing from about 3 to about 10 carbon atoms and said aryl groups containing from 6 to 8 carbon atoms, the total number of carbon atoms in all three aryl groups in said triaryl phosphates being from 19 to 24.

10. A functional fluid composition as defined in claim 1, said polyalkylene glycol viscosity index improver being a polyalkylene glycol ether containing at least one terminal oxyalkyl group from 1 to 4 carbon atoms.

11. A functional fluid composition as defined in claim 1, said polyalkylene glycol ether being a member selected from the group consisting of polypropylene glycol and copolymer of ethylene oxide and propylene oxide, mono- and diethers.

12. A functional fluid composition as defined in claim 5, said polyalkylene glycol ether being a member selected from the group consisting of polypropylene glycol and copolymer of ethylene oxide and propylene oxide, mono- and diethers.

13. A functional fluid composition as defined in claim 10, wherein said phosphorus compound is a phosphate ester selected from the group consisting of dialkyl aryl, triaryl, trialkyl and alkyl diaryl phosphates, said alkyl groups containing from about 3 to about 10 carbon atoms and said aryl groups containing from 6 to 8 carbon atoms, the total number of carbon atoms in all three aryl groups in said triaryl phosphates being from 19 to 24.

14. A functional fluid composition as defined in claim 12, wherein said phosphorus compound is a phosphate ester selected from the group consisting of dialkyl aryl, triaryl, trialkyl and alkyl diaryl phophates, said alkyl groups containing from about 3 to about 10 carbon atoms and said aryl groups containg from 6 to 8 carbon atoms, the total number of carbon atoms in all three aryl groups in said triaryl phosphates being from 19 to 24.

15. A functional fluid composition as defined in claim 1, wherein said phosphorus compound is employed in an amount ranging from about 75 to about 98%, said polyalkylene glycol viscosity index improver is employed in an amount ranging from about 1 to about 15%, by weight.

16. A functional fluid composition as defined in claim 14, wherein said phosphorus compound is employed in an amount ranging from about 75 to about 98%, said polyalkylene glycol viscosity index improver is employed in an amount ranging from about 1 to about 15%, by weight.

17. A functional fluid composition as defined in claim 1, wherein said phosphorus compound is a phosphate ester selected from the group consisting of dibutyl phenyl phosphate, octyl diphenyl phosphate and tributyl phosphate.

18. A functional fluid composition as defined in claim 1, said polyalkylene glycol viscosity index improver being selected from the group consisting of the copolymer of ethylene oxide and propylene oxide, monobutyl ether, having a molecular weight ranging from about 4000 to about 5000, and polypropylene glycol monomethyl ether, having a molecular weight ranging from about 2000 to about 3000.

19. A functional fluid composition as defined in claim 17, said polyalkylene glycol viscosity index improver being selected from the group consisting of the copolymer of ethylene oxide and propylene oxide, monbutyl ether, having a molecular weight ranging from about 4000 to about 5000, and polypropylene glycol monomethyl ether, having a molecular weight ranging from about 2000 to about 3000.

20. A functional fluid composition as defined in claim 1, said polyepoxide being a member selected from the group consisting of epoxy novalacs, the polyglycidyl ethers of phenols and polyphenols, polyglycidyl amines, polyepoxide esters, epoxidized polybutadiene and polyallyl glycidyl ether.

21. A functional fluid composition as defined in claim 20, wherein said phosphorus compound is a phosphate ester selected from the group consisting of dibutyl phenol phosphate, octyl diphenyl phosphate and tributyl phosphate, and wherein said polyalkylene glycol viscosity index improver is selected from the group consisting of the copolymer of ethylene oxide and propylene oxide, monobutyl ether, having a molecular weight ranging from about 4000 to about 5000, and polypropylene glycol monomethyl ether having a molecular weight ranging from about 2000 to about 3000.

22. A functional fluid composition as defined in claim 21, wherein said phosphorus compound is employed in an amount ranging from about 75 to about 98%, said polyalkylene glycol viscosity index improver is employed in an amount ranging from about 1 to about 15%, by weight.

23. A functional fluid composition as defined in claim 22, wherein said polyepoxide is a member selected from the group of epoxy compounds having the formulae:

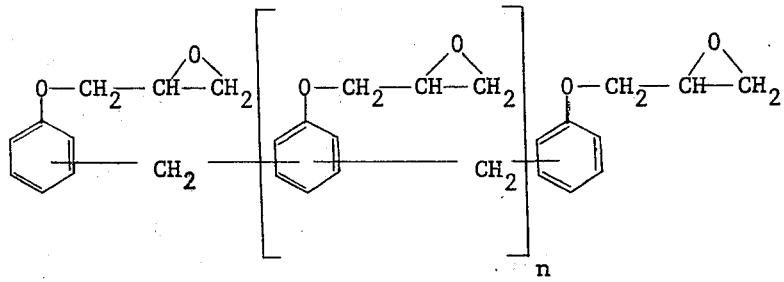

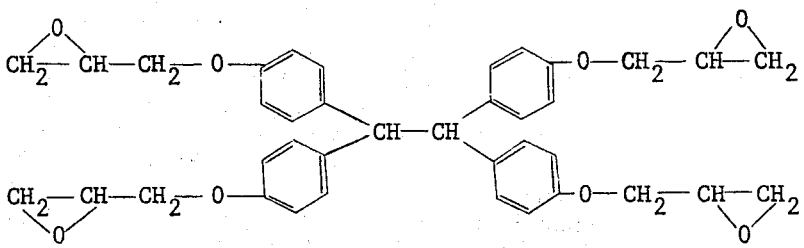

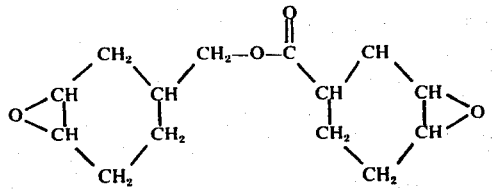

wherein $n$ can range from 0 to about 10.

24. A functional fluid composition as defined in claim 23, wherein said phosphorus compound is a phosphate ester selected from the group consisting of dibutyl phenyl phosphate, octyl diphenyl phosphate and tributyl phosphate, and wherein said polyalkylene glycol viscosity index improver is selected from the group consisting of the copolymer of ethylene oxide and propylene oxide, monobutyl ether, having a molecular weight ranging from about 4000 to about 5000, and polypropylene glycol monomethyl ether, having a molecular weight ranging from about 2000 to about 3000.

25. A functional fluid composition as defined in claim 24, wherein said phosphorus compound is employed in an amount ranging from about 75 to about 98%, said polyalkylene glycol viscosity index improver is employed in an amount ranging from about 1 to about 15%, by weight.

* * * * *